US008758279B2

(12) United States Patent
Karnwie-Tuah

(10) Patent No.: US 8,758,279 B2
(45) Date of Patent: Jun. 24, 2014

(54) BODY CONTOURED STIMULATING AND REJUVENATING SYSTEM

(76) Inventor: Daniel Karnwie-Tuah, Camarillo, CA (US)

( * ) Notice: Subject to any disclaimer, the term of this patent is extended or adjusted under 35 U.S.C. 154(b) by 663 days.

(21) Appl. No.: 12/897,306

(22) Filed: Oct. 4, 2010

(65) Prior Publication Data

US 2012/0083721 A1 Apr. 5, 2012

(51) Int. Cl.
*A61H 23/00* (2006.01)

(52) U.S. Cl.
USPC ..... 601/46; 601/61; 601/71; 601/134

(58) Field of Classification Search
USPC ..... 601/37, 40, 46, 49, 56–58, 61, 65, 67, 601/69–71, 74, 78, 79, 81, 84, 86, 87, 89, 601/90, 93–95, 98, 101, 103, 107, 111, 112, 601/113, 118, 120–122, 124–128, 130–132, 601/134; 606/204, 204.15, 204.25, 204.35
See application file for complete search history.

(56) References Cited

U.S. PATENT DOCUMENTS

| | | | | | |
|---|---|---|---|---|---|
| 1,539,299 | A * | 5/1925 | Cheney | 601/20 |
| 1,611,542 | A * | 12/1926 | Mair | 606/204.35 |
| 4,169,466 | A * | 10/1979 | Wong | 601/131 |
| 4,469,092 | A | 9/1984 | Marshall et al. | |
| 4,577,625 | A * | 3/1986 | Lohati et al. | 601/128 |
| 4,796,616 | A * | 1/1989 | Panahpour | 601/131 |
| 4,841,954 | A * | 6/1989 | Kalsi | 601/71 |
| 5,072,724 | A * | 12/1991 | Marcus | 601/148 |
| 5,099,829 | A * | 3/1992 | Wu | 601/46 |
| 5,405,310 | A * | 4/1995 | Yoo | 601/134 |
| 5,628,772 | A * | 5/1997 | Russell | 607/109 |
| 5,797,859 | A | 8/1998 | Prehodka | |
| 5,857,985 | A | 1/1999 | Feng | |
| 5,928,262 | A * | 7/1999 | Harber | 606/204.35 |
| 6,224,538 | B1 * | 5/2001 | Wang et al. | 600/19 |
| 6,401,252 | B1 * | 6/2002 | Dean | 2/160 |
| 6,711,750 | B1 * | 3/2004 | Yoo | 2/338 |
| 7,168,873 | B2 * | 1/2007 | Shawan et al. | 401/6 |
| 7,207,953 | B1 * | 4/2007 | Goicaj | 601/46 |
| 8,052,326 | B2 * | 11/2011 | Pike | 384/49 |
| 2003/0204152 | A1 * | 10/2003 | Tsai | 601/46 |
| 2004/0006293 | A1 * | 1/2004 | Huang | 601/134 |
| 2005/0059911 | A1 * | 3/2005 | Lin | 601/70 |
| 2006/0010630 | A1 * | 1/2006 | Tse | 15/160 |
| 2008/0255486 | A1 * | 10/2008 | Ludlow | 601/169 |
| 2009/0224616 | A1 * | 9/2009 | An | 310/81 |

* cited by examiner

*Primary Examiner* — Quang D Thanh

(57) ABSTRACT

A device is taught that rejuvenates the skin of a users brow, eyes and body which consists of a vibrating sheet. The vibrating sheet of flexible contains a series of holes through the surface in a parallel array. An acrylic sphere partially passes through each hole permitting containment therein. A layer of silicone, the same thickness as the sheet, sandwiches the spheres, and a coin-sized vibrating motor powered by a battery is adhered to the body with a belt member retaining the device onto the user.

16 Claims, 4 Drawing Sheets

BODY CONTOURED STIMULATING AND REJUVENATING SYSTEM

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention is a battery operated, motor driven stimulating and rejuvenating pad for application to various areas of a user. The stimulating effects of the pad are intended to reinvigorate the skin, giving the user a more youthful, energetic appearance. Stimulating and rejuvenating devices are known in the art.

U.S. Pat. No. 5,797,859 to Prehodka discloses a massager for producing vibratory massage motion including a base structure, a support plate with a contact surface and a mounting surface, and resilient mounts for coupling the support plate to the base structure. At least one rotator structure is associated with the contact surface of the support plate and includes massage members. A motor is attached to the mounting surface of the support plate and manifests a first direction rotary output and a counter direction rotary output. A gear structure couples the motor to the at least one rotator structure to cause rotary movement thereof, upon actuation of the motor. Although this device includes a contact surface with massage members, the contact surface is of a uniform shape, and is unable to contour to the body of a user.

U.S. Pat. No. 5,857,985 to Feng discloses a health massage device including a fixing frame enclosed within an elastic material, and an oscillating device installed on the frame. A control switch is installed on a panel situated on said elastic material, the control switch being arranged to switch between an audio control mode in which a strength of oscillations of said massager is controlled by an audio signal input through an audio input jack, and an internal signal control mode in which the oscillating device is caused to oscillate in response to an internal fixed or variable internal signal source. Although this device discloses an elastic material with vibrating massaging functions, it cannot contour to the body, and fails to disclose the silicon covered spheres of the present invention.

U.S. Pat. No. 4,469,092 to Marshal et al discloses an electro mechanical system for stimulating the human scalp including a rigid helmet adapted to be placed upon the head of a patient to be treated, with an internal pad comprising integral, stimulating finger members which directly contact the scalp of the patient. A vibration motor housed within the helmet communicates mechanically with the pad to gently vibrate same to stimulate the scalp. Although this device is designed to contour to an area of the body, it cannot be used on areas other than the head. Also, the device does not have the self-contained battery and motor of the present invention.

Therefore it is an object of the present invention to provide a self-contained stimulating and rejuvenating device that is pliable and portable. A further object of the present invention is to provide a series of stimulating spheres under a layer of hypoallergenic silicone, which vibrate through the use of a quiet coin-sized motor. Finally it is an object of the present invention to provide a battery powered control for each device. These and other objects will become apparent in light of the appended summary, description and claims.

SUMMARY

The present invention comprises an improved device for stimulating and rejuvenating various areas of the body, including the brow, areas around the eyes, contours of the arms and legs, and the hands. Although specific embodiments of the device are designed for different areas of the body, all embodiments are comprised of the same elements.

In all embodiments the device is made from a sheet of flexible pliable material, and formed into the proper shape for covering an area of the user's body. A series of holes arrayed across the surface of the material are sized to accommodate a series of uniformly sized acrylic spherical members. The spherical members are larger in diameter than the holes, permitting them to be held in place without falling through the holes.

The spherical members are further anchored in place by a silicone sheet placed over the spherical members and adhered to them and the flexible material. Because of the small size of the holes, the spherical members protrude into the silicone sheet to a greater degree than through the holes of the flexible sheet, creating an array of pressure points on the silicone side of the device. In one preferred embodiment, the flexible sheet and silicon sheet are of the same thickness.

A coin sized vibrating low frequency motor, or series of motors is disposed between the flexible sheet and the silicone sheet, causing the entire sheet to vibrate when activated. Because of their small size, the motors can vibrate while generating very little sound. The vibrations caused by the motors are low frequency; in the 10 to 50 Hz range. The motor is powered by a battery attached to the side of each device. A series of wires connecting the motor to the battery are disposed between the silicone sheet and flexible sheet. In one preferred embodiment of the invention, the eye covering member is fitted into a blind which is worn by the user.

Various embodiments of the invention for application to the brow, thighs and abdomen, and hands have the motor disposed as centrally as possible, with wires extending to a battery and on/off case adjacent to the device. Additionally, other embodiments for application to the arms, calves, and other areas of the body are contemplated. The battery and on/off switch may control one or multiple sheets covering different areas of the body, or a single battery and on/off source may comprise a switch board for controlling multiple devices with the same battery unit. In one preferred embodiment, the devices are held against the person of a user by an expandable belt, or a belt with a fastening means, including a buckle.

FIGURES

DESCRIPTION

The present invention comprises an improved device for stimulating and rejuvenating the brow, areas around the eyes and contours of the body; including the hands. Although different embodiments of the device are designed for different areas of the body, all embodiments are comprised of the same elements. The embodiment covering the eyes of a user is exemplary.

Figure 1:
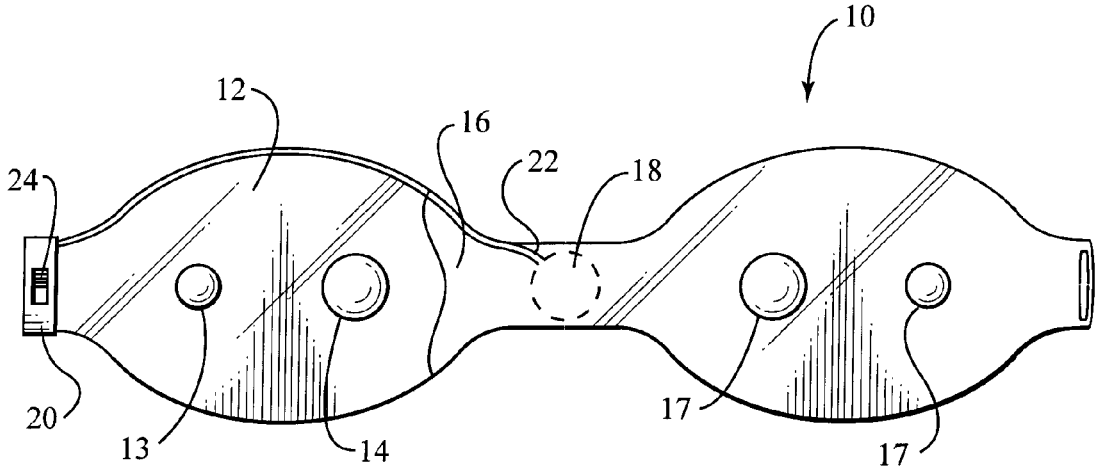
FIG. 1 is a front view of the device of the present invention for covering the eyes of a user with one corner of the silicone material removed.

Referring to FIG. 1, device 10 is made from a single sheet of flexible and pliable material 12, and formed into a shape for covering the eyes of a user. A series of holes 13 are arrayed across the surface of the material 12. Each hole 13 is sized to accommodate an acrylic spherical member 14. The spherical members 14 are larger in diameter than the holes 13; permitting the spherical members 14 to be held in place without falling through the holes 13.

Still referring to FIG. 1, the spherical members are further held in place by a silicone sheet 16, placed over the spherical members 14 and flexible material 12. Because of the small size of the holes, the spherical members 14 protrude into the silicone 16 sheet to a greater degree than through the holes 13 of the flexible sheet 12, creating an array of pressure points 17 on the silicone side of the device 10. In one preferred embodiment, the flexible sheet and silicon sheet are of the same thickness.

Still referring to FIG. 1, a coin sized vibrating low frequency motor 18 is disposed between the flexible sheet 12 and the silicone sheet 16. When activated, the motor causes the entire sheet 10 to vibrate at a low frequency between 10 and 50 Hz to stimulate and exercise the muscles beneath the device 10 and promote muscle tone and growth. When worn over the eyes, the device stimulates and softens the eye lenses, and rejuvenates the muscles, improving vision. Because of its small size, the motor can vibrate while generating very little sound. The motor 18 is powered by a battery 20 attached to the side of the device 10. A series of wires 22 connecting the motor to the battery and on/off control 24 are disposed between the silicone sheet 16 and flexible sheet 12. In one preferred embodiment of the invention, the eye covering member is fitted into a blind which is worn by the user.

Figure 2:
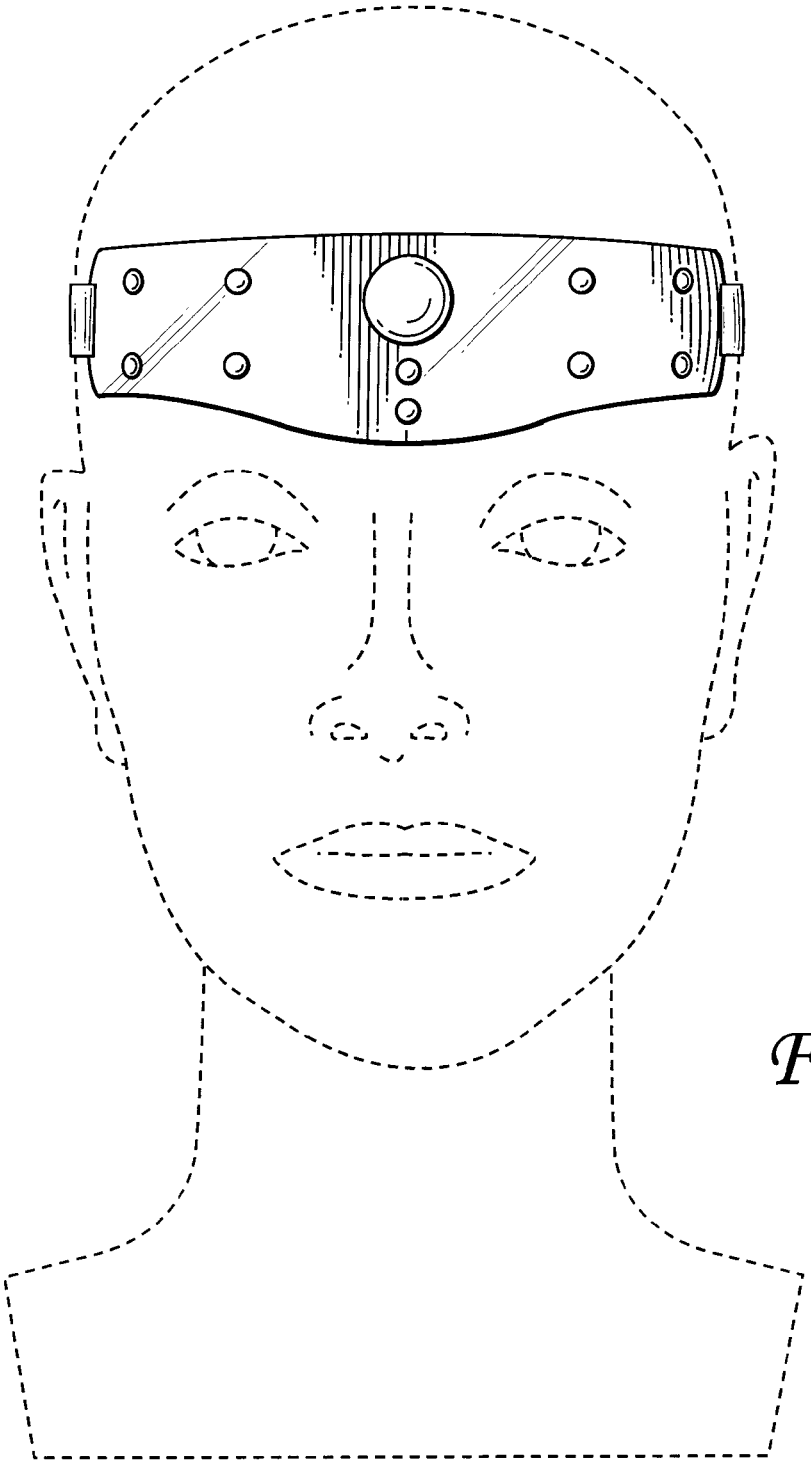
FIG. 2 is a front view of the device of the present invention for covering the brow of a user.
Figure 3:
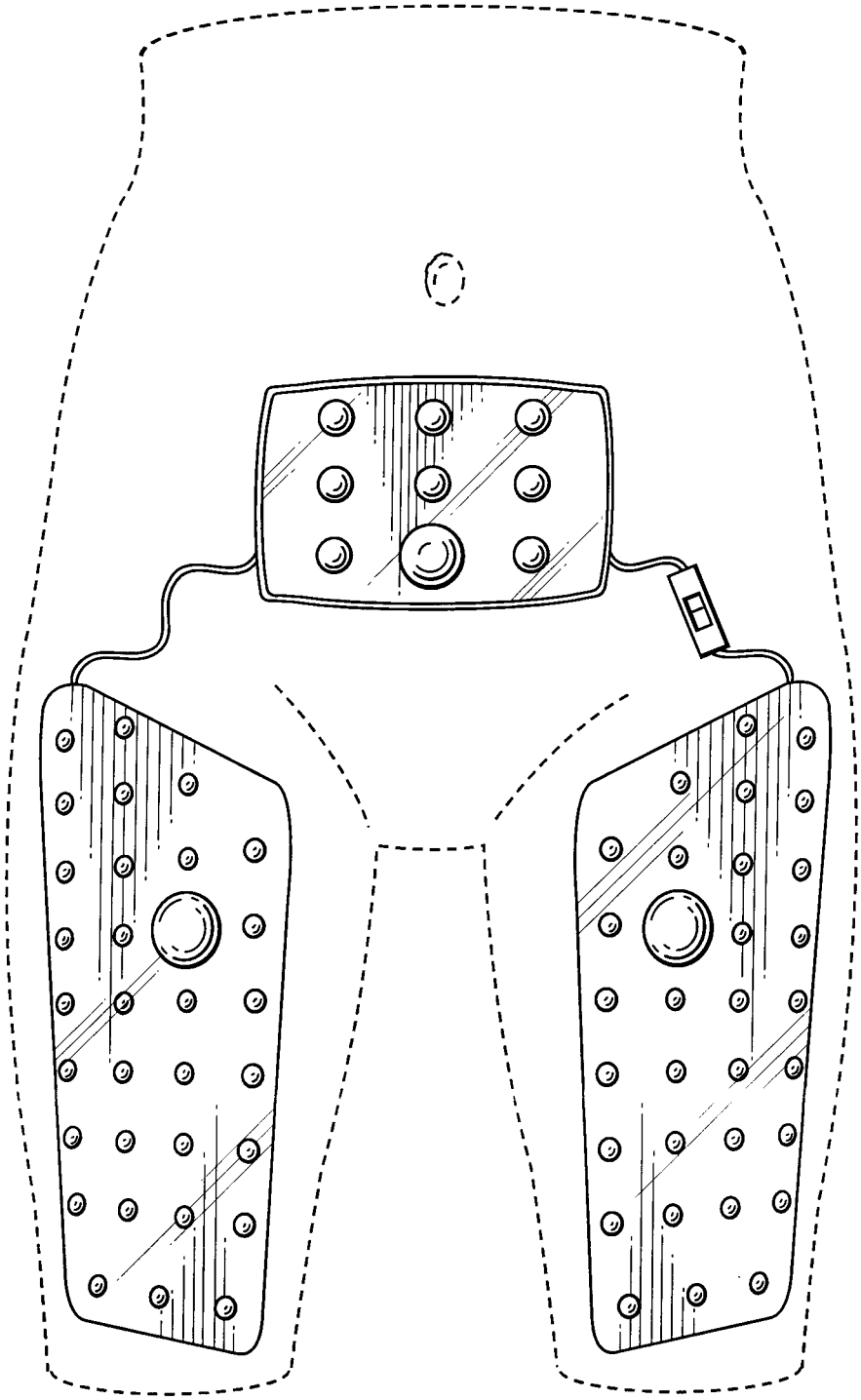
FIG. 3 is a front view of the device of the present invention for covering the thighs and abdomen of a user.
Figure 4:
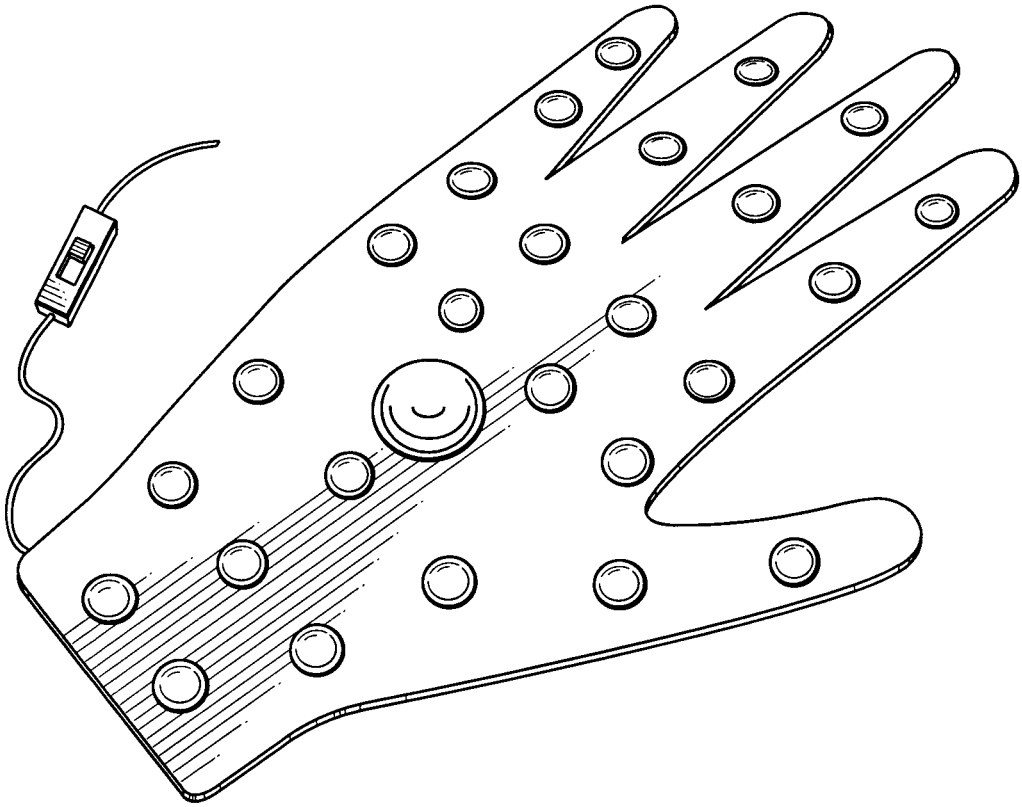
FIG. 4 is a front view of the device of the present invention for covering the hand of a user.

Referring to FIGS. 2, 3 and 4, various embodiments of the invention for application to the brow, thighs and abdomen, and hands are shown, respectively. In each embodiment, the motor is disposed as centrally as possible, with wires extending to a battery and on/off case adjacent to the device. In addition to these specific embodiments, other embodiments for application to the arms, calves, and other areas of the body are contemplated. It is contemplated that multiple sized devices for covering the hands will be offered.

In other embodiments of the invention, the battery and on/off switch may control one or multiple sheets covering different areas of the body. In yet another embodiment, a single battery and on/off source may comprise a switch board for controlling multiple devices with the same battery unit. In one preferred embodiment, the devices are held against the person of a user by an expandable belt, or a belt with a fastening means, including a buckle. In the embodiment of the device for covering the legs of a user, it is anticipated that the sheet will be at least nine inches in width. It is anticipated that in any embodiment, use of the device for 15 minutes per day will result in increased musculature, and rejuvenated skin. In preferred embodiments, wherein the device is used for toning the skin of the arms, the stomach or the thighs of a user, 30 minutes of use per day is anticipated.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A device adapted to stimulating and rejuvenating variously body regions comprising;

a) at least one thin, flexible and pliable sheet of material such that it can be resistant to breaking and cracking completely, the at least one sheet of material having a series of holes formed in the material, the at least one sheet of material adapted to covering the various regions of a user's body, b) a plurality of spheres, comprising acrylic, mounted into the at least one sheet of material and held in position by series of holes, the plurality of spheres extending beyond a plane of the sheet of material adapted to engaging a user skin, c) at least one vibrating motor defined as a coin vibration motor, disposed onto the at least one sheet of material, such that when activated, the entire sheet vibrates along with the at least one motor at between 10 and 50 Hz, causing the plurality of spheres to vibrate against the user, and d) at least one flexible layer of silicone applied to a user side of the at least sheet of material through which the plurality of spheres protrude retaining the spheres in place.

2. The device of claim 1, wherein the body regions are adapted to be vibrated include a brow, an area around eyes, arms, an abdomen, legs, calves and hands.

3. The device of claim 1, wherein the at least one sheet of material includes, a flexible sheet adapted to cover upper legs, which is nine inches in width.

4. The device of claim 1, wherein the plurality of spheres have a diameter that is larger than the series of holes.

5. The device of claim 1, wherein the plurality of spheres are aligned with the series of holes.

6. The device of claim 1, wherein the at least one flexible layer of silicone is of the same thickness as the at least one sheet of material.

7. The device of claim 1, wherein the at least one vibrating motor is essentially centered on the device.

8. The device of claim 1, wherein the at least one vibrating motor is an industry standard coin low frequency motor.

9. The device of claim 1, wherein the at least one vibrating motor is battery-powered.

10. The device of claim 1, wherein the at least one vibrating motor is controlled by a separate on/off switch.

11. The device of claim 1, wherein more than one vibrating motor is controlled by a single battery and an on/off switch.

12. The device of claim 1, wherein an on/off switch controls more than one sheet of material disposed on different regions of a user's body.

13. The device of claim 1, wherein the at least one vibrating motor is disposed on the at least one sheet of material by way of a series of wires connecting the at least one vibrating motor to a battery and an on/off switch, wherein the series of wires are disposed between the layer of silicone and the at least one sheet of material.

14. The device of claim 1, wherein the at least one sheet of material further having an attachment article for fastening onto a user.

15. The device of claim 14, wherein the attachment article is a belt member, including a belt member of expandable material.

16. The device of claim 14, wherein the device is designated a blind worn to cover the users eyes.

* * * * *